US005788086A

United States Patent [19]

Azaroff et al.

[11] Patent Number: 5,788,086

[45] Date of Patent: Aug. 4, 1998

[54] CARTRIDGE FOR STORING AND DISPENSING MIRROR MOUNT BUTTONS

[75] Inventors: Vladamir Azaroff, Midland, Mich.; Joseph P. Hoppe, Kernersville, N.C.; Brian D. Kruse; Gary L. Thompson, both of Midland, Mich.

[73] Assignee: Dow Corning Corporation, Midland, Mich.

[21] Appl. No.: 576,651

[22] Filed: Dec. 21, 1995

[51] Int. Cl.[6] ..... A47F 7/00

[52] U.S. Cl. ..... 211/13.1; 211/41.1; 211/194; 206/445; 206/449

[58] Field of Search ..... 211/13, 41, 59.4, 211/194; 206/445, 449, 509, 455, 456

[56] References Cited

U.S. PATENT DOCUMENTS

| | | | |
|---|---|---|---|
| 3,203,123 | 8/1965 | Dominy | 206/456 X |
| 3,606,007 | 9/1971 | Huston | 206/449 X |
| 4,574,959 | 3/1986 | Hollett | 211/41 |
| 4,658,960 | 4/1987 | Iwasa | 206/456 X |
| 5,160,780 | 11/1992 | Ono et al. | 428/220 |
| 5,351,836 | 10/1994 | Mori et al. | 211/41 |
| 5,577,621 | 11/1996 | Yi | 211/41 |

*Primary Examiner*—Robert W. Gibson, Jr.
*Attorney, Agent, or Firm*—Robert L. McKellar

[57] ABSTRACT

This invention deals in one aspect with a novel cartridge for storing and dispensing mirror mount buttons, and in another aspect with a novel cartridge that can be capped for shipping and transferring cartridges that are full of ready-to-use mirror buttons.

12 Claims, 3 Drawing Sheets

CARTRIDGE FOR STORING AND DISPENSING MIRROR MOUNT BUTTONS

This invention deals with a novel cartridge for storing and dispensing mirror mount buttons.

In the manufacture of modern automobiles, the rearview mirror installation has been changed from a nut and bolt type of mount to a mount that requires an adhesive to do the mounting on the interior surface of the front windshield.

In actuality, the adhesive is carried by a mirror button, which is configured to provide a base for the adhesive which is used to mount the mirror button on the interior of an automobile windshield. After mounting to the windshield, the button is configured such that it is used as a means of attaching the base of the mirror to finish the mirror mounting. Such an attachment means can be found in U.S. Pat. No. 5,160,780, issued Nov. 3, 1992 to Ona, et al.

The device of the instant invention is a cartridge for storing and dispensing mirror mount buttons, one type of button being described and disclosed in the Ona, et al patent at FIG. 7, part 41.

PRIOR ART

The applicants are aware of cartridges being used on application equipment that is used to manufacture automobile windshields having rearview mirrors mounted on them. Such cartridges currently in use are not unitary in construction and do not have the novel features of the instant cartridge.

BRIEF DESCRIPTION OF THE INVENTION

This invention deals in one aspect with a novel cartridge for storing and dispensing mirror mount buttons, and in another aspect with a novel cartridge that can be capped for shipping and transferring cartridges that are full of ready-to-use mirror buttons, that is mirror buttons containing adhesive on their top surface.

Thus, this invention deals with a cartridge comprising a rectangular tubular housing having open ends. The housing has a horizontal midpoint, a top, a bottom, which has an exterior surface, two identical side walls, each said side wall having an interior surface. Each of the interior surfaces bear a plurality of shelving components.

The top of the rectangular tubular housing is surmounted by a dual rail running the length of the rectangular tubular housing and the exterior surface of the bottom of the rectangular tubular housing is configured in a notch, wherein the notch runs the length of the rectangular tubular housing and has a depth and width configured to accept a dual rail.

The rectangular tubular housing has a brace attached to the interior of the housing and the brace runs essentially from the interior surface of one side wall to the interior surface of the opposite side wall and extends the length of the rectangular tubular housing.

What is most important is that the cartridge is of a unitary construction.

Another aspect of this invention is a means of capping the open ends of the cartridge with plastic caps to prevent the mirror mount buttons contained inside to be shipped and transferred without losing them.

THE INVENTION

This invention deals with a novel cartridge that is useful for storing and shipping mirror mount buttons.

Figure 1A:
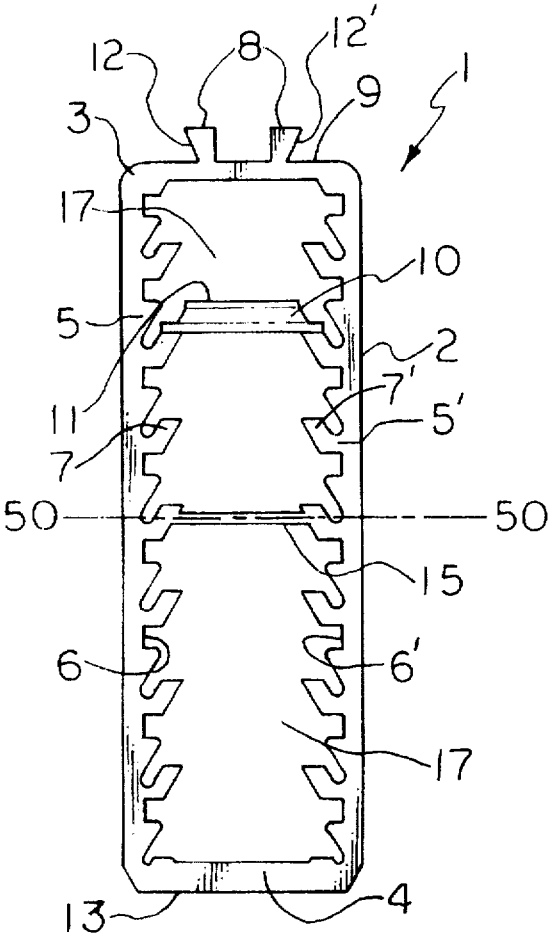
FIG. 1A is an full end view of a cartridge of this invention containing a mirror mount button in place.
Figure 1B:
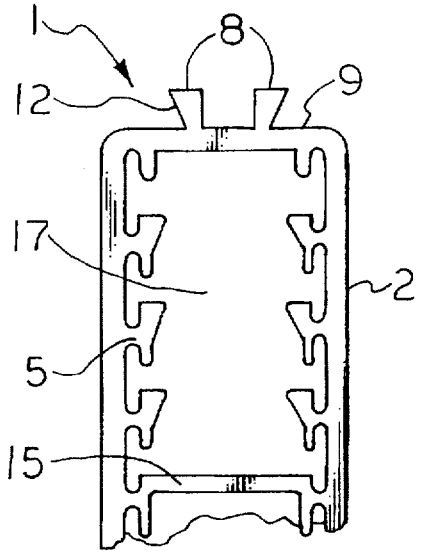
FIG. 1B illustrates another embodiment of FIG. 1A.

With reference to FIGS. 1A and 1B, there is shown an end view of a cartridge 1 of this invention which is a rectangular tubular housing 2 having a horizontal midpoint, line 50—50, a top 3, and a bottom 4. The bottom has an exterior surface 13, shown in both FIG. 1A and FIG. 2. It should be noted that the horizontal midpoint discussed supra is recited only for the benefit of describing the invention with clarity, and the horizontal midpoint does not form a part of the device claimed herein. "Horizontal" for purposes of the drawings means a line drawn through the device parallel with the top edge of the paper containing the drawing.

The rectangular tubular housing has two identical side walls 5 and 5' and each of the side walls 5 and 5' have an interior surface 6 and 6'.

Figure 2:
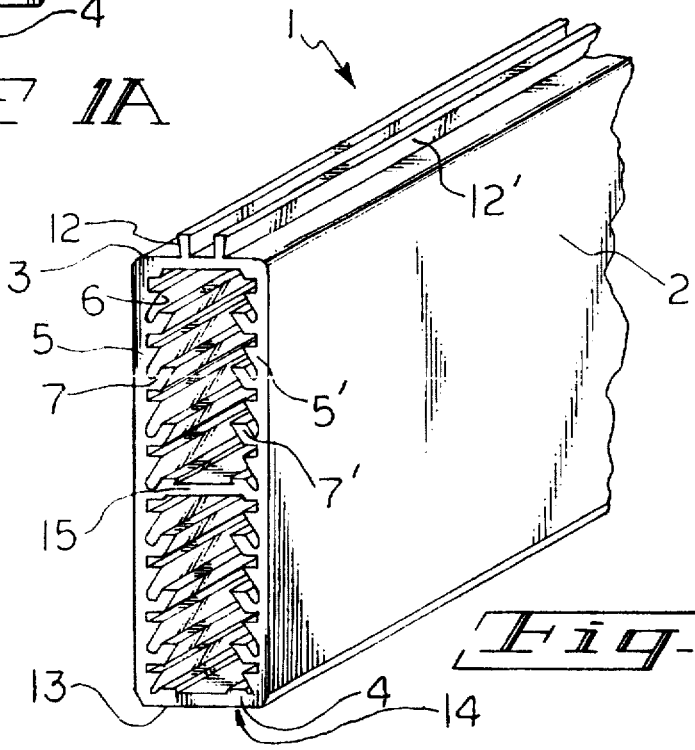
FIG. 2 is an isometric view of the cartridge of this invention.
Figure 3:
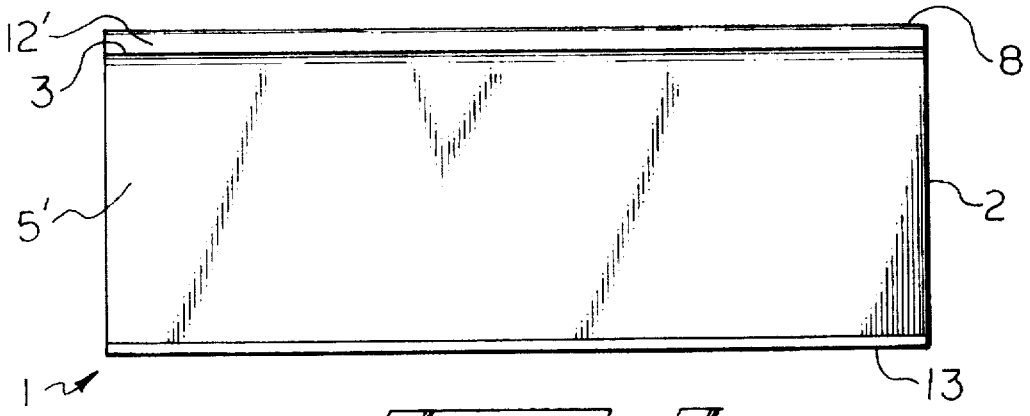
FIG. 3 is a side view of a cartridge of this invention.

As can be observed from FIGS. 1A, 1B, and 2, the interior surfaces 6 and 6' have multiple shelving elements 7 and 7'. These shelves 7 and 7' extend the entire length of the rectangular tubular housing 2. In operation, these multiple shelves 7 and 7' hold the mirror mount buttons 10, each set of shelving from side to side holding one line of such buttons 10.

The number of shelves 7 and 7' is not narrowly critical, and for most end uses, a minimum of four, and a maximum of ten are generally employed, with the preferred number of shelves 7 and 7' being about six. The distance between the shelve pairs 7 and 7' is proscribed by the types of buttons 10 that are to be stored and shipped in the cartridge 1. For example, the width needs to be wide enough to allow the buttons 10 to move by the force of gravity when the cartridge 1 is tilted downwardly, but the width should not be such that the buttons 10 can drop off of the shelve and down onto the next layer of buttons 10. The amount of opening between one set of shelves 7 and 7' and the set of shelves 7 and 7' above or below it, should be such that the adhesive 11 on the top of the button does not contact any part of the next button 10, or the interior of the cartridge 1. In the event that the adhesive 11 does make such a contact, then the cartridge 1 is jammed and will not work efficiently. Generally, a two foot length of cartridge 1 contains approximately 150 buttons 10, it being understood that the cartridge 1 can be of any convenient length, such as several inches up to several feet.

The top 3 of the rectangular tubular housing 2 has a dual rail 8 located on its top surface 9. The purpose of this rail 8 is twofold. It is designed to be a support for any other cartridge 1 which is placed thereon, as such cartridges 1 in actual use on the equipment are stacked, one on top of the other. The dual rail 8, it will be noted has slightly inclined walls 12 and 12' which necessarily need to be inclined to allow a robot to pick up the cartridge 1 and move it onto a stack of such cartridges 1, or move such cartridges 1 from the stack and back to a storage area. It is contemplated by the inventors herein that the dual rail 8 can be continuous along the top surface 9 of the rectangular tubular housing 2, or it can be discontinuous, there being present sufficient amount of dual rail 8 to allow the robot to contact and move the cartridge 1.

It can further be observed that the bottom 4 has a notch 14 configured into its surface 13. The notch 14 extends for the entire length of the cartridge 1. The notch 14 is configured to allow for the insertion of a dual rail 8 from another cartridge 1 in order to help hold and support an upper cartridge 1 on top of a lower cartridge 1.

The cartridge 1 of this invention is manufactured by extrusion, and because of the overall size of the cartridge 1, there are some problems associated with such extrusions such as, for example, the side walls 5 and 5' having a tendency to form in an irregular manner, and the like. Thus, there is provided at about the horizontal midpoint 50—50, an inner brace 15, which extends between interior surfaces 6 and 6' of side walls 5 and 5'. The brace 15 runs the entire length of the rectangular tubular housing 2 in order to stabilize the rectangular tubular housing 2, although, it could be discontinuous.

Such a brace 15 tends to prevent the problems with extrusion as set forth supra.

The cartridge 1 of this invention is of a unitary construction and does not require the bolts/screws required in the prior art devices. The cartridge 1 of this invention does not require extensive machining to provide shelving, does not require extensive machining to provide threaded holes and the like and is therefore much less expensive to manufacture.

Figure 5:
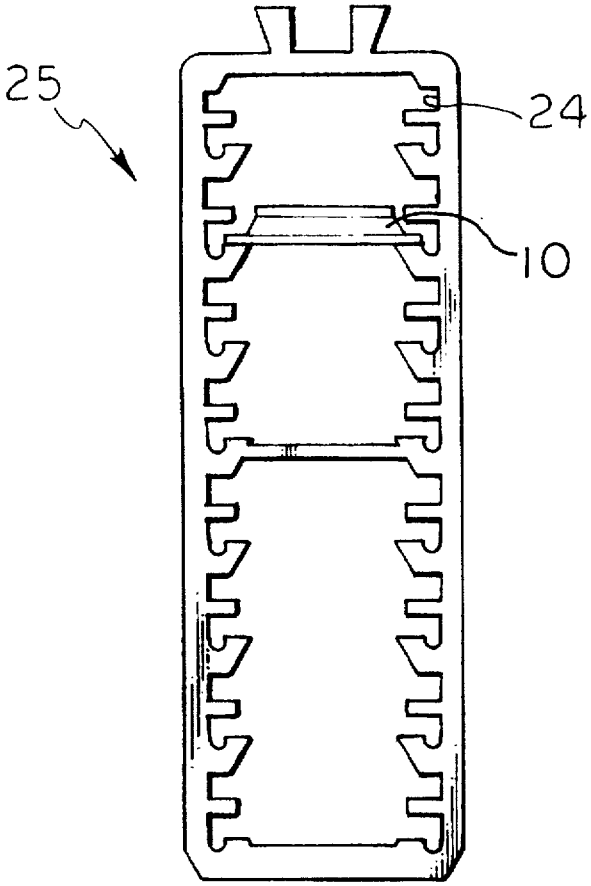
FIG. 5 is a full end view of another embodiment of the invention showing the interior design of the cartridge for a wing style button.
Figure 6:
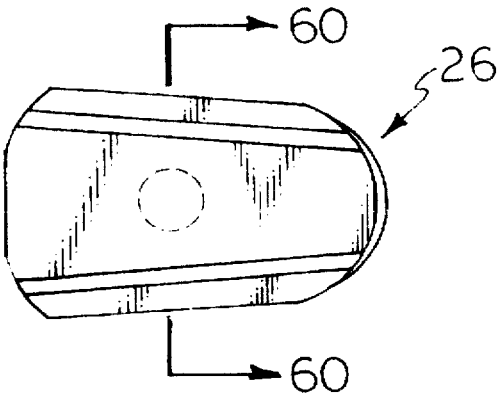
FIG. 6 is a full top view of the wing style button.
Figure 7:
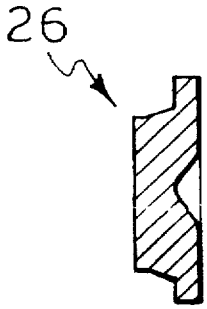
FIG. 7 is a cross sectional view of the button of FIG. 6 through the line 60—60.

Another embodiment of this invention is a cartridge 25, which has its interior 24 configured to accept wing style buttons 26. Such an embodiment is shown in FIG. 5. A wing style button 26 is shown in FIG. 6, which is a full top view. A cross-sectional view of the button taken through line 60—60 is shown in FIG. 7.

For purposes of shipping and storing, the cartridge 1 can have a cap on one end, or it can have a cap on both ends, depending on the need.

Figures 4A, 4B, 4C:
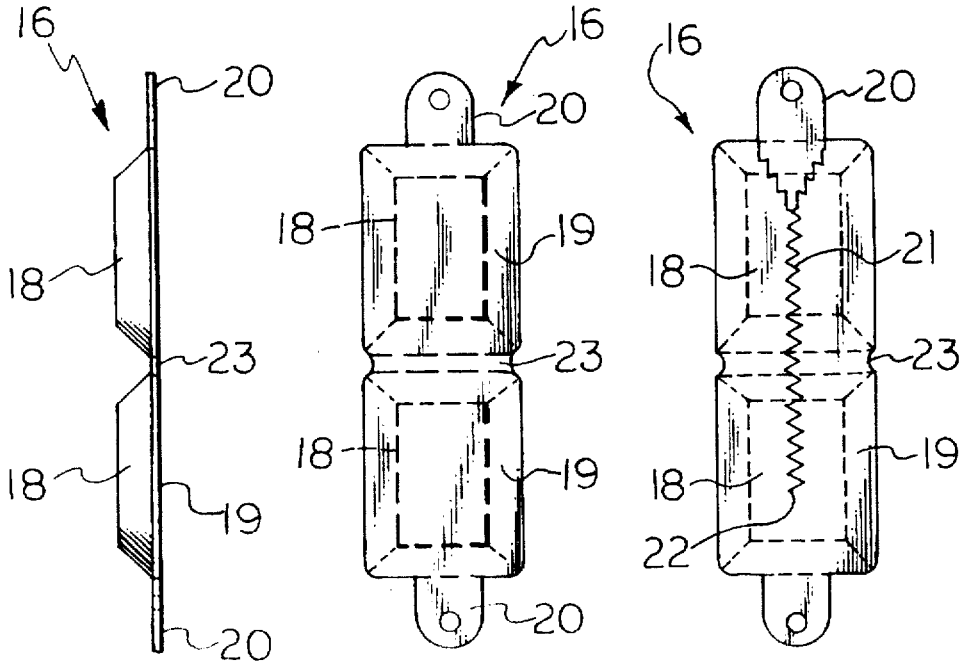
FIG. 4A is a full side view of the cap of this invention.
FIG. 4B is a full front view of the cap of this invention.
FIG. 4C is a full front view of another embodiment of the cap of FIG. 4B.

The cap 16, shown in FIGS. 4A and 4B is of the type that is insertable in the openings 17 of the rectangular tubular housing 2.

The cap 16 is configured such that the bottom 18 of the cap 16, shown in FIG. 4A and in phantom in FIG. 4B, is small in size to fit easily into the openings 17. The top edge 19 of the cap 16 provides a retainer ring for the cap 16 such that it will not slip down into the interior of the cartridge 1. Further, there is provided on at least one end of the cap 16, and integrally bonded thereto, a tab 20 which can be used to remove the cap 16 when it is not needed. It is preferable to have a tab 20 at each end of the cap 16 for convenience. Finally, the cap 16 has a thin bar of material 23 joining the two cap segments together. As is obvious, this thin bar must be configured such that the cap can slip down over the brace 15 so as not to interfere with the seating of the cap 16 in the openings 17.

There can be further provided in the cap 16, a perforated strip 21, extending from a tab 20, and extending through the middle of the cap 16 to a point somewhat below the midpoint of the cap 16, such as point 22.

In use, the cartridge 1 is filled with mirror mount buttons 10 which have adhesive applied to the top side thereof. The cartridges are then capped using the cap 16 on both ends, and then the cartridges are suitable for storage and/or shipping. At the site where the cartridges are to be used, one end cap is used, the cartridge is moved to the application equipment and the equipment is provided with the cartridge such that the open end of the cartridge is tilted in a downwardly direction, which allows the buttons to be dispensed from the cartridge onto a conveyor line. The application equipment provides the means for allowing the smooth flow of the buttons to the conveyor line. Such application equipment, including the means to control the flow of buttons to the conveyor line are not considered part of this invention.

What we claim is:

1. A cartridge, said cartridge comprising a rectangular tubular housing having open ends, said housing having a horizontal midpoint, a top, a bottom, which has an exterior surface, two identical side walls, each said side wall having an interior surface;

each said interior surface bearing a plurality of shelving components;

the top of the rectangular tubular housing being surmounted by a dual rail running the length of the rectangular tubular housing;

the exterior surface of the bottom of the rectangular tubular housing being configured in a notch, said notch running the length of the rectangular tubular housing and having a depth and width configured to accept a dual rail therein;

said rectangular tubular housing having a brace attached to the interior of the housing, said brace running essentially from the interior surface of one side wall to the interior surface of the opposite side wall and extending the length of the rectangular tubular housing;

said cartridge being of a unitary construction.

2. A cartridge as claimed in claim 1 in which there is at least four shelving components.

3. A cartridge as claimed in claim 1 in which there is at least six shelving components.

4. A cartridge as claimed in claim 1 in which there is at least eight shelving components.

5. A cartridge as claimed in claim 1 which is manufactured from plastic.

6. A cartridge as claimed in claim 1 which is manufactured from metal.

7. A cartridge as claimed in claim 6 which is manufactured from aluminum.

8. A cartridge as claimed in claim 1 wherein at least one of the open ends of the rectangular tubular housing is capped with a removable cap.

9. A cartridge as claimed in claim 1 wherein both ends of the rectangular tubular housing are capped.

10. A cartridge as claimed in claim 8 wherein the removable cap is fabricated from plastic.

11. A cartridge as claimed in claim 8 wherein the plastic cap has a tab for gripping and removal of the cap.

12. A cartridge as claimed in claim 8 wherein the plastic cap has a tear-away configuration for removal of the cap.

* * * * *